United States Patent [19]

Stevens et al.

[11] 4,404,666

[45] Sep. 13, 1983

[54] QUICK DEPLOYMENT VEHICLE

[75] Inventors: Arthur P. Stevens, Jenkintown; John De Matteo, Doylestown, both of Pa.; Richard M. Beard, Ventura, Calif.

[73] Assignee: The United States of America as represented by the Secretary of the Navy, Washington, D.C.

[21] Appl. No.: 269,171

[22] Filed: Jun. 2, 1981

[51] Int. Cl.[3] ..... B63B 21/28

[52] U.S. Cl. ..... 367/131; 114/295; 367/2

[58] Field of Search ..... 367/2, 131, 134; 441/33; 114/294, 295; 73/170 A

[56] References Cited

U.S. PATENT DOCUMENTS

| | | | |
|---|---|---|---|
| 3,372,665 | 3/1968 | Mesler | 114/294 |
| 3,384,867 | 5/1968 | Bridges | 367/2 |
| 3,455,151 | 7/1969 | Richard | 73/170 A |
| 3,517,469 | 6/1970 | Brown | 114/295 X |
| 3,622,962 | 11/1971 | Winget et al. | 367/131 |

*Primary Examiner*—Richard A. Farley

*Attorney, Agent, or Firm*—R. S. Sciascia; Henry Hansen

[57] ABSTRACT

A quick deployment vehicle (QDV) for implanting a transponder or beacon on the ocean bottom in an upright position exposed for receiving or transmitting acoustic signals. The vehicle includes a ballistic body of separable fore and aft sections. The fore section includes a core mass for penetrating the ocean sediment, and the aft section includes a beacon for signal transmission. A predetermined interval after impact, as determined by a programmed deceleration profile stored in memory, the sections will separate. The sensed deceleration of the vehicle is compared at predetermined intervals to the stored profile, and when the sensed level is less than the stored level, a squib is fired to separate the two sections. The aft section penetrates and remains exposed above the sediment, while the fore section further penetrates into the ocean bottom.

5 Claims, 6 Drawing Figures

QUICK DEPLOYMENT VEHICLE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to free fall vehicles for quick deployment to the ocean bottom; and more particularly to transponders or beacons operationally deployable from the surface of the ocean for embedment in an upright position on ocean bottoms having sediment of unknown consistency.

A quick and accurate beacon navigation system (BNS) has been developed for determining the geodetic position of a submarine or surface vessel. The system includes a free-fall vehicle which deploys a single acoustic beacon to the ocean floor, a hydrophone array mounted on the hull of the vessel for detecting acoustic signals from the beacon, and a signal processor for measuring the vessel's bearing angle relative to the beacon. The bearing measurements are combined with position and attitude obtained from other systems such as an inertial navigation system (INS) to yield accurate navigation data. Typically, the beacon is part of a buoy which is attached by means of a tether to an embedment anchor. Due to its size and lack of streamlining, the vehicle descends slowly and drifts with ocean current. For example, with an average ocean current of one-half knot, the vehicle may drift 3,000 feet in 20,000 feet of descent. The actual position of the deployed beacon after coming to rest must then be surveyed by time-consuming and costly procedures.

Streamlining the vehicle will increase the descent rate and ensure a more vertical trajectory, but the vehicle penetration depth in the sediment may be excessive, particularly where transponders and beacons must remain exposed above the sediment for optimum performance. The consistency (density, viscosity, firmness, etc.) of typical sediments, such as pelagic clay, calcareous ooze, and loose or medium sand, vary widely and is not usually known for the location of the vechicle deployment.

SUMMARY OF THE INVENTION

Accordingly, it is an object of the present invention to provide a quick deployment vehicle which will free fall in the ocean along a substantially vertical trajectory and penetrate the bottom to a desired depth. Still another object is to provide a quick deployment vehicle particularly suited for transponders, beacons and the like, which will embed in the ocean bottom in an upright position with the transducer remaining above the sediment regardless of its consistency. A further object is to provide a quick deployment vehicle which can be launched from a submarine or surface vessel to a predictable geodetic position on the ocean floor, and which can be used in a beacon navigation system for quickly and accurately determining the geodetic position of a submarine or surface vessel. A still further object is to provide a quick deployment vehicle which is relatively simple and inexpensive to manufacture and operate, and which is reliable and expendable.

Briefly, these and other objects of the invention are accomplished with a hydrodynamically streamlined vehicle for achieving rapid and vertical free fall in the ocean, and with separable fore and aft sections containing a core mass and payload respectively. An accelerometer and an impact sensor within the vehicle activate a release circuit which, upon proper vehicle deployment, separates the two sections if the deceleration is less than a predetermined level, such as occurs in soft, low density sediment. The aft section thereby remains in a vertical position exposed above the sediment while the fore section continues to penetrate further into the ocean bottom. Conversely, if the deceleration exceeds the predetermined level, such as occurs in hard, high density sediment, the aft section will remain attached to the fore section and penetrate further into the sediment. The extent of penetration of each section, combined or separated, is determined by their respective masses, typical consistencies of sediment, and hydrodynamic configuration.

For a better understanding of the invention and other objects of the invention, reference is made to the following detailed description taken in conjunction with the accompanying drawings wherein:

DESCRIPTION OF THE PREFERRED EMBODIMENT

Figure 1:
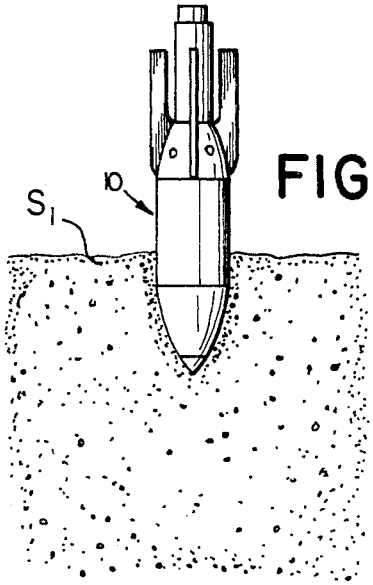
FIG. 1 is an elevation view of a quick deployment vehicle according to the invention operationally deployed at the ocean bottom in relatively firm sediment.

Referring now to the drawings, wherein like characters designate like or corresponding parts throughout the several views, there is shown in FIG. 1 a quick deployment beacon-type vehicle 10 imbedded in the upright position in the ocean bottom consisting of a relatively high density sediment $S_1$.

Figure 2:
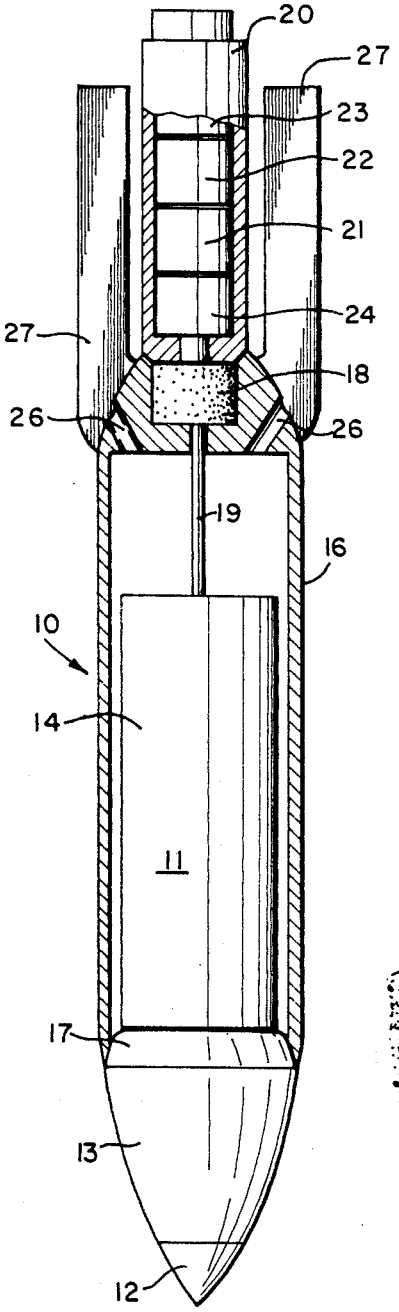
FIG. 2 is a longitudinal view, partially in cross-section, of the vehicle of FIG. 1.

As best seen in FIG. 2, the fore section of vehicle 10 comprises a ballistic penetrator 11 having an impact sensor 12 at the nose tip and a core mass within a nacelle section 13 and reduced-diameter columnar section 14. The aft section of vehicle 10 comprises cylindrical housing 16 extending over section 14 with the forward end contiguously fitted about a shoulder 17 located between the nacelle and columnar sections 13 and 14 respectively.

The aft end of housing 16 contains an electrically fired squib 18 which releasably secures the distal end of a rod 19 extending from and rigidly connected to the aft end of penetrator 11. A payload housing 20 extending from the aft end of housing 16 encloses an accelerometer 21, a penetrator release circuit 22, and a beacon 23 each powered by a battery 24.

Four stabilizing fins 27 equally spaced about and extending from the aft end of housing 16 maintain a vertical trajectory during free fall of the vehicle 10, and four openings 26 formed in the aft end of housing 16 ventilate the interior of the housing 16 as it moves down over the entrapped sediment during penetration of the separated aft section.

The vehicle 10 is preferably designed to reach a terminal velocity in free fall of 100 feet/second and to imbed in two extremes of sediment. In the most dense sediment, at least one foot of penetration is desired to ensure vertical embedment; and in the least dense sediment, penetration is limited so as not to cover the beacon 23. In the illustrated embodiment these design objectives are achieved with a vehicle of 4.5 feet length, 5 inches diameter, and 185 and 30 pounds fore and aft sections weight distribution respectively.

Figure 3:
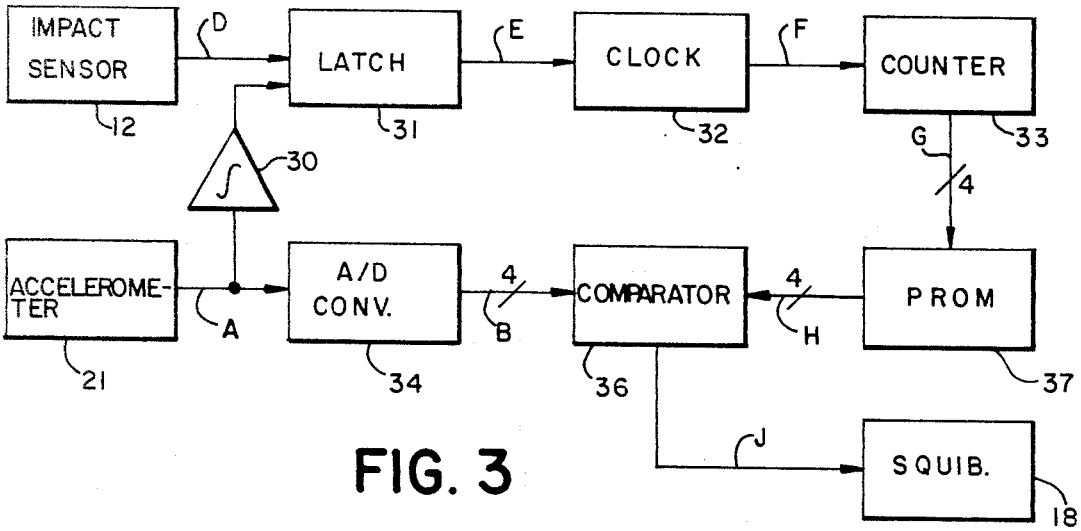
FIG. 3 is an electrical block diagram of a release circuit utilized in the vehicle of FIG. 1.

Referring now to the electrical diagram of FIG. 3, accelerometer 21 produces an analog output signal A corresponding to the vehicle acceleration which is converted to a four bit digital signal B by an analog-to-digital (A/D) converter 34. Signal A is also integrated with time to a vehicle velocity signal C by integrator 30. A latch 31, receiving signal C and an impact signal D from sensor 12, produces an enabling signal E when signals C and D are above predetermined threshold levels indicative of free fall of the vehicle 10 through the ocean and impact with the bottom. The enabling signal E starts clock 32 to generate a clock signal F of constant pulse repetition rate, such as 1 Khz. Counter 33 receives the clock pulses and produces a 4-bit digital signal G indicative of the number of pulses after impact. A programmable read-only memory (PROM) 37 receives signal G and produces a 4-bit digital signal H word indicative of predicted accelerations for corresponding elapsed time intervals such as at 1, 3, 5, 7 and 9 milliseconds. A comparator 36 receives the signals B and H from converter 34 and PROM 37 to produce a firing signal J to squib 18 when the signal B (acceleration sensed) is less than signal H (the predicted value) at corresponding time intervals. Squib 18 is fired to release the fore section of vehicle 10.

Figure 4A:
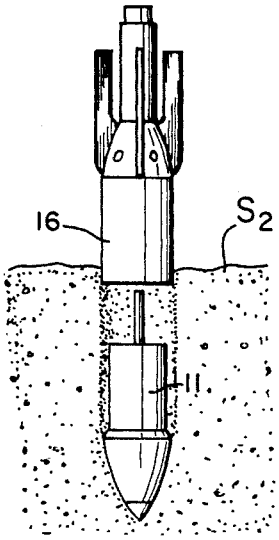
FIGS. 4*a* and 4*b* illustrate the vehicle of FIG. 1 in different stages of operation in relatively soft sediment.
Figure 4B:
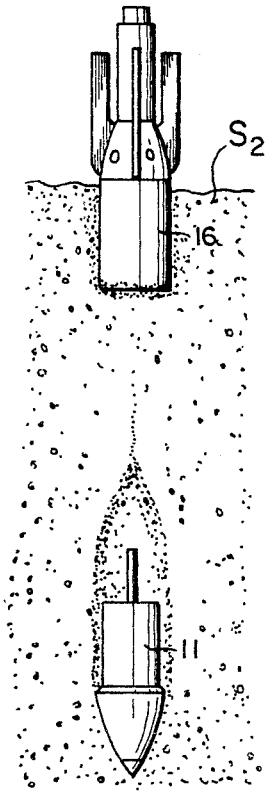
Figure 5:
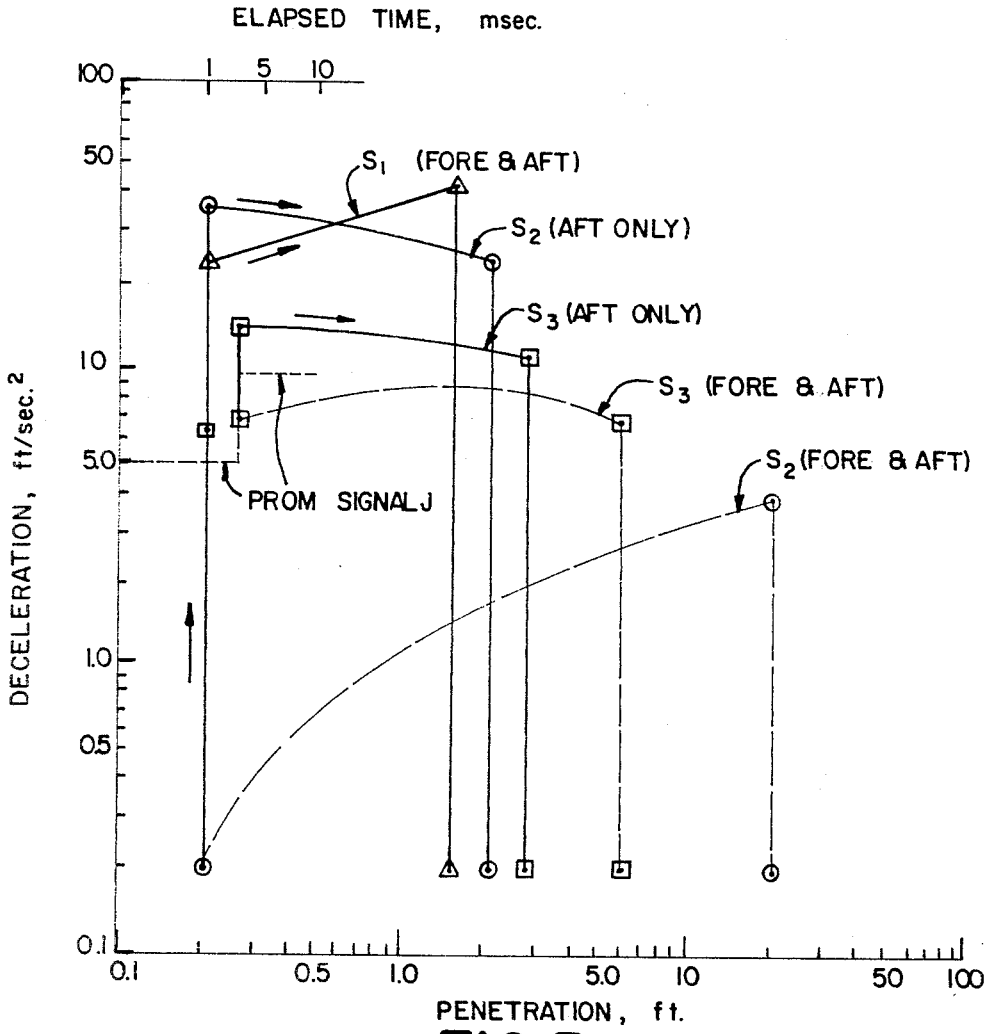
FIG. 5 is a logarithmic graph of typical penetration depths of a vehicle according to the invention in various types of sediment.

Operation of the invention, as applied to three discrete constituencies of ocean sediment, will now be summarized. FIG. 5 illustrates typical decleration and penetration characteristics for the vehicle 10 in the three types of sediment: the high density loose sand $S_1$ of FIG. 1, the low density pelagic clay $S_2$ of FIGS. 4*a* and 4*b*, and a medium density sediment $S_3$. From preliminary vehicle penetration testing and analysis of the disclosed embedment, it is postulated that decelerations less than 5 ft./sec.$^2$ in the first 3 msec. after impact, or deceleration between 5 and 10 ft./sec.$^2$ in the following 3 to 7 msec., requires release of the core mass to ensure embedment of the aft section of one to three feet. PROM 37 is therefore programmed to produce a signal H of 5 ft./sec.$^2$ for the first 3 msec. and then 10 ft./sec.$^2$ for an additional 7 msec.

When the geodetic position of a vessel is desired, vehicle 10 is launched to free fall in the ocean. Its streamlined configuration and fins 27 maintain descent in a vertical trajectory to attain a speed of 50 to 100 ft./sec. to produce a threshold velocity signal C to latch 31.

Assuming impact with hard ocean sediment $S_1$, sensor 12 produces a signal D which, together with signal C, operates latch 31 and starts clock 32 and counter 33. As shown in FIG. 5, the vehicle deceleration is 24 ft/sec$^2$. Signals A and B being greater than PROM signal H, the comparator 36 will not generate firing signal J and the fore and aft sections of vehicle 10 remain connected. As shown in FIG. 1, the core mass threfore ensures sufficient embedment to approximately 1.5 feet for proper beacon positioning.

Now assuming instead that soft sediment $S_2$ is struck, vehicle deceleration is 0.2 ft/sec$^2$. Being less than PROM signal H, signals A and B will cause a signal J from comparator 36 to fire squib 18 and separate the fore and aft sections of vehicle 10 as shown in FIGS. 4*a* and 4*b* and by the solid line for sediment $S_2$ of FIG. 5. The aft section deceleration substantially increases to 38 ft/sec$^2$ and embeds to an operating depth of about 2 feet. The fore section continues to penetrate to a substantial depth in the ocean bottom. As shown by the dash line for sediment $S_2$, if the fore and aft sections did not separate, the vehicle 10 would continue to penetrate to a depth of 20 feet, rendering the beacon useless.

Further assuming that medium sediment $S_3$ is struck instead of sediment $S_1$ or $S_2$, vehicle deceleration from 1 to 3 msec. after impact is 6.4 to 7.0 ft/sec$^2$. Being greater than the PROM signal H of 5.0 ft/sec$^2$, no separation occurs. However, from 3 to 10 msec. after impact, the PROM signal H increases to 10.0 ft/sec$^2$. Since the signals A and B are now less than signal H, the fore and aft sections separate. As shown by the solid line for sediment $S_3$, the aft section deceleration therefore increases to 15 ft/sec$^2$ and finally embeds to an operating depth of 2.8 feet. The fore section further penetrates below the ocean bottom out of play. If the fore and aft sections did not separate, as shown by the dash line for sediment $S_3$, the vehicle 10 would penetrate to 6 feet and completely bury the beacon.

After proper positioning, and by means not part of the invention nor disclosed, beacon 23 generates acoustic signals for detection by a remote station, such as the launching vessel, from which geodetic position data may be derived.

Some of the many advantages of the invention should now be apparent. For example, vehicle is provided which is amenable to many applications where it is desired to implant a free fall object at a predetermined depth in ocean bottoms in which the consistency of the sediment is unknown. It is particularly suitable for rapidly deploying and accurately implanting a navigational transponder or beacon from a submarine or surface vessel to the ocean bottom for geodetic positioning. The vehicle automatically compensates for soft or firm bottom sediments so that it will not completely bury itself and render it useless for its purpose such as receiving or transmitting acoustic signals. The vehicle also includes design features for preventing premature operation, for insuring embedment in an upright position, and for allowing ease of handling. The trajectory is rapid and essentially vertical thus insuring against drift to an unknown position due to the water currents. Implantation is greatly simplified, and surveying for the embedment position, such as by acoustic interrogation from a vessel, is thereby obviated.

It will be understood that various changes in the details, steps and arrangement of parts, which have been herein described and illustrated in order to explain the nature of the invention, may be made by those skilled in the art within the principal and scope of the invention as expressed in the appended claims.

We claim:

1. A quick deployment vehicle for embedment in ocean sediment comprising, in combination:

a streamlined housing having separable fore and aft sections, said fore section including a core mass for imparting an inertial force for penetrating the sediment;

memory means within said housing for storing a programmed predetermined deceleration and for transmitting a signal indicative thereof, said memory means includes a vehicle condition sensor for initiating the predetermined deceleration signal and timing means initiated by said condition sensor for regulating the predetermined deceleration signal as a function of elapsed time;

decelertion sensing means within said housing responsive to the vehicle deceleration for transmitting a signal indicative thereof;

separating means connected to fore and aft sections and responsive to the vehicle deceleration and predetermined deceleration signals for separating said sections when the predetermined deceleration signal exceeds the vehicle deceleration signal.

2. A vehicle according to claim 1 wherein said vehicle condition sensor further includes means responsive to contact with the ocean bottom.

3. A vehicle according to claim 2 wherein said vehicle condition sensor further includes means responsive to a preselected level of vehicle velocity.

4. A quick deployment vehicle for implanting a transponder in ocean sediment comprising, in combination:

a streamlined housing separable fore and aft sections, said fore section including a core mass for imparting an inertial force for penetrating the sediment;

an ocean bottom sensor within said housing for producing a signal in response to contact of the vehicle with the sediment;

an accelerometer within said housing for producing a signal indicative of vehicle acceleration;

an integrator responsive to said acceleration for producing signal indicative of vehicle velocity;

a latch responsive to said contact and velocity signals for producing an enabling signal when signals of contact and a preselected velocity are indicated;

a clock responsive to said enabling signal for producing a pulse frequency signal when initiated by said enabling signal;

a counter responsive to said pulse frequency signal for producing an elapsed time signal;

a read-out memory responsive to said time signal for producing a programmed acceleration signal;

comparator means responsive to said acceleration and programmed signals for producing a separation signal when the programmed signal exceeds the acceleration signal; and separator means connected to said fore and aft sections and responsive to said separation signal for separating said sections.

5. A quick deployment vehicle in accordance with claim 4 wherein said bottom sensor includes means responsive to impact with the sediment.

* * * * *

UNITED STATES PATENT AND TRADEMARK OFFICE

CERTIFICATE OF CORRECTION

PATENT NO. : 4,404,666

DATED : September 13, 1983

INVENTOR(S) : Arthur P. Stevens et al

It is certified that error appears in the above-identified patent and that said Letters Patent are hereby corrected as shown below:

Column 6, line 1, after "housing" insert -- having --.

Signed and Sealed this

Tenth Day of July 1984

[SEAL]

Attest:

GERALD J. MOSSINGHOFF

Attesting Officer

Commissioner of Patents and Trademarks